US007931500B2

(12) United States Patent
Knaub et al.

(10) Patent No.: US 7,931,500 B2
(45) Date of Patent: Apr. 26, 2011

(54) ELECTRICAL CONNECTOR SYSTEM

(75) Inventors: John Edward Knaub, Etters, PA (US); Robert Paul Nichols, Santa Rosa, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/648,700

(22) Filed: Dec. 29, 2009

(65) Prior Publication Data

US 2010/0144204 A1 Jun. 10, 2010

Related U.S. Application Data

(63) Continuation-in-part of application No. 12/474,674, filed on May 29, 2009.

(60) Provisional application No. 61/205,194, filed on Jan. 16, 2009, provisional application No. 61/200,955, filed on Dec. 5, 2008.

(51) Int. Cl.
*H01R 13/648* (2006.01)

(52) U.S. Cl. ..... 439/607.07

(58) Field of Classification Search ..... 439/607.05, 439/607.07, 701

See application file for complete search history.

(56) References Cited

U.S. PATENT DOCUMENTS

| | | | | |
|---|---|---|---|---|
| 3,783,433 | A * | 1/1974 | Kurtz et al. | 439/82 |
| 5,882,227 | A | 3/1999 | Neidich | |
| 6,506,076 | B2 | 1/2003 | Cohen et al. | |
| 6,676,450 | B2 | 1/2004 | Schroll | |
| 6,709,294 | B1 | 3/2004 | Cohen et al. | |
| 6,808,414 | B2 * | 10/2004 | Spiegel et al. | 439/579 |
| 6,843,687 | B2 * | 1/2005 | McGowan et al. | 439/607.06 |
| 6,899,566 | B2 | 5/2005 | Kline et al. | |
| 6,932,626 | B2 | 8/2005 | Costello et al. | |
| 7,101,191 | B2 * | 9/2006 | Benham et al. | 439/65 |
| 7,163,421 | B1 | 1/2007 | Cohen et al. | |
| 7,207,807 | B2 | 4/2007 | Fogg | |
| 7,217,889 | B1 | 5/2007 | Parameswaran et al. | |
| 7,335,063 | B2 | 2/2008 | Cohen et al. | |
| 7,371,117 | B2 | 5/2008 | Gailus | |
| 7,381,092 | B2 | 6/2008 | Nakada | |
| 2003/0022555 | A1 | 1/2003 | Vicich et al. | |
| 2009/0011642 | A1 * | 1/2009 | Amleshi et al. | 439/608 |

* cited by examiner

*Primary Examiner* — Phuong K Dinh

(57) ABSTRACT

An electrical connector system may include a plurality wafer assemblies that engage with a substrate. Each wafer assembly includes a housing that defines a plurality of projections extending from an edge of the housing at a mounting end of the wafer assembly. At least a portion of a projection of the plurality of projections of the housing is dimensioned to fit into a corresponding hole in a substrate when the housing is engaged with the substrate. In some implementations, the projection is positioned on the housing to block a line-of-sight between a first signal substrate engagement element of an array of electrical contacts associated with the housing and a second signal substrate engagement element of the array of electrical contacts.

22 Claims, 12 Drawing Sheets

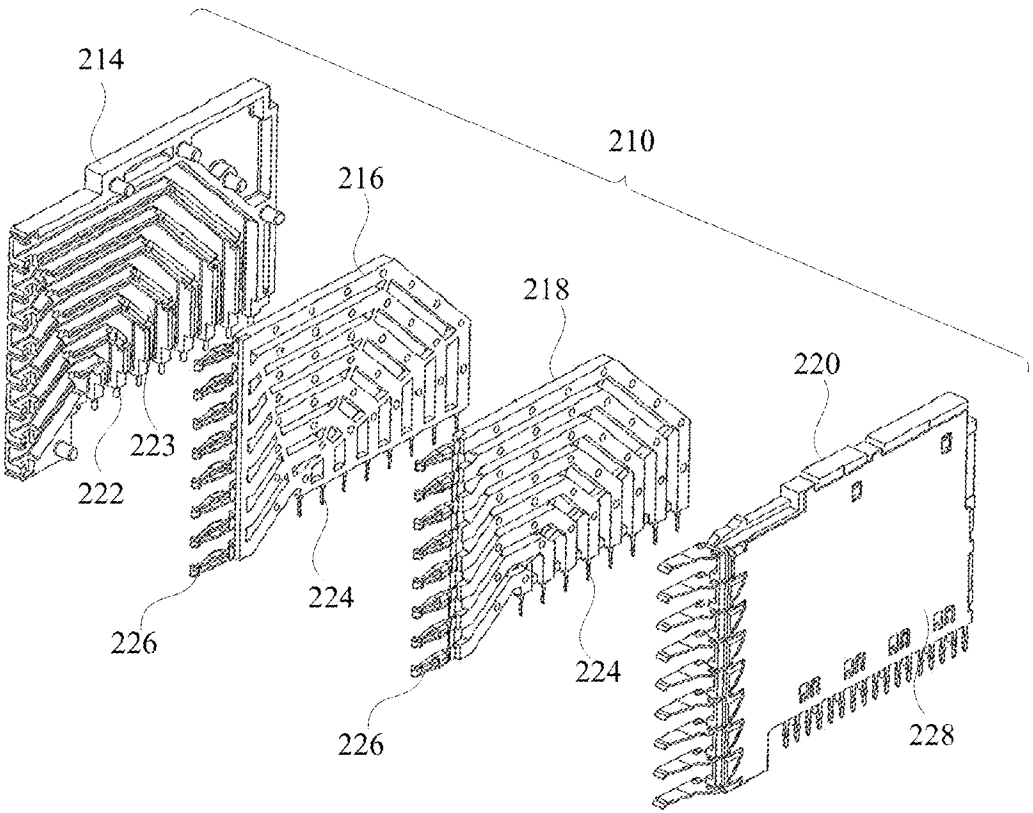
Fig. 2B
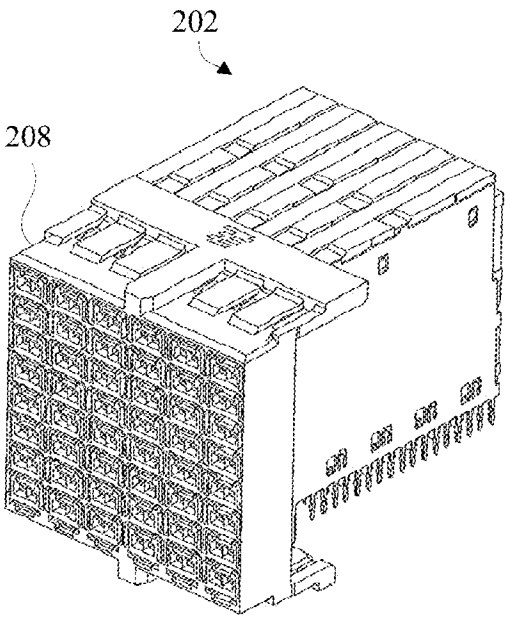

ELECTRICAL CONNECTOR SYSTEM

PRIORITY CLAIM

This application is a continuation-in-part of U.S. patent application Ser. No. 12/474,674 (still pending), filed May 29, 2009, which claims priority to U.S. Provisional Pat. App. No. 61/200,955, filed Dec. 5, 2008, and claims priority to U.S. Provisional Pat. App. No. 61/205,194, filed Jan. 16, 2009, the entirety of each of these applications is hereby incorporated by reference.

RELATED APPLICATIONS

The present application is related to U.S. patent application Ser. Nos. 12/474,568, 12/474,587, 12/474,605, 12/474,545, 12/474,505, 12/474,772, 12/474,626, and 12/474,674, each titled "Electrical Connector System," each filed May 29, 2009, and each claiming priority to U.S. Provisional Pat. App. No. 61/200,955, filed Dec. 5, 2009 and U.S. Provisional Pat. App. No. 61/205,194, filed Jan. 16, 2009, the entirety of each of which is hereby incorporated by reference.

BACKGROUND

Backplane connector systems are typically used to connect a first substrate, such as a printed circuit board, in a parallel or perpendicular relationship with a second substrate, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY

An electrical connector system may include a plurality wafer assemblies that engage with a substrate. In one implementation, each wafer assembly includes a first housing and a second housing configured to mate with the first housing. The first housing defines a plurality of projections extending from an edge of the first housing at a mounting end of the wafer assembly. Similarly, the second housing defines a plurality of projections extending from an edge of the second housing at the mounting end of the wafer assembly. At least a portion of a projection of the plurality of projections of the first housing and at least a portion of a projection of the plurality of projections of the second housing are dimensioned to fit into corresponding holes in a substrate when the first housing and the second housing are engaged with the substrate.

In another implementation, a wafer assembly is provided that includes a housing that defines a plurality of electrical contact channels and a plurality of projections extending from an edge of the housing at a mounting end of the wafer assembly. An array of electrical contacts of the wafer assembly is positioned substantially within the plurality of electrical contact channels. Each electrical contact of the array of electrical contacts defines a signal substrate engagement element extending past the edge of the housing at the mounting end of the wafer assembly. At least a portion of a first projection of the plurality of projections is dimensioned to fit into a corresponding hole in a substrate when the housing is engaged with the substrate. The first projection is positioned on the housing to block a line-of-sight between a first signal substrate engagement element of the array of electrical contacts and a second signal substrate engagement element of the array of electrical contacts.

In a further implementation, an electrical connector system includes a plurality of wafer assemblies. Each wafer assembly includes a first housing, a first array of electrical contacts, a second housing, and a second array of electrical contacts. The electrical connector system also includes an organizer positioned at the mounting end of the plurality of wafer assemblies. A plurality of projections of the first housing and a plurality of projections of the second housing are dimensioned to pass through apertures of the organizer and into corresponding holes in a substrate when the first housing and the second housing are engaged with the substrate.

Other systems, methods, features and advantages will be, or will become, apparent to one with skill in the art upon examination of the following figures and detailed description.

BRIEF DESCRIPTION OF THE DRAWINGS

FIG. 2B is a partially exploded view of the electrical connector system of FIG. 2A.

DETAILED DESCRIPTION

Figure 1:
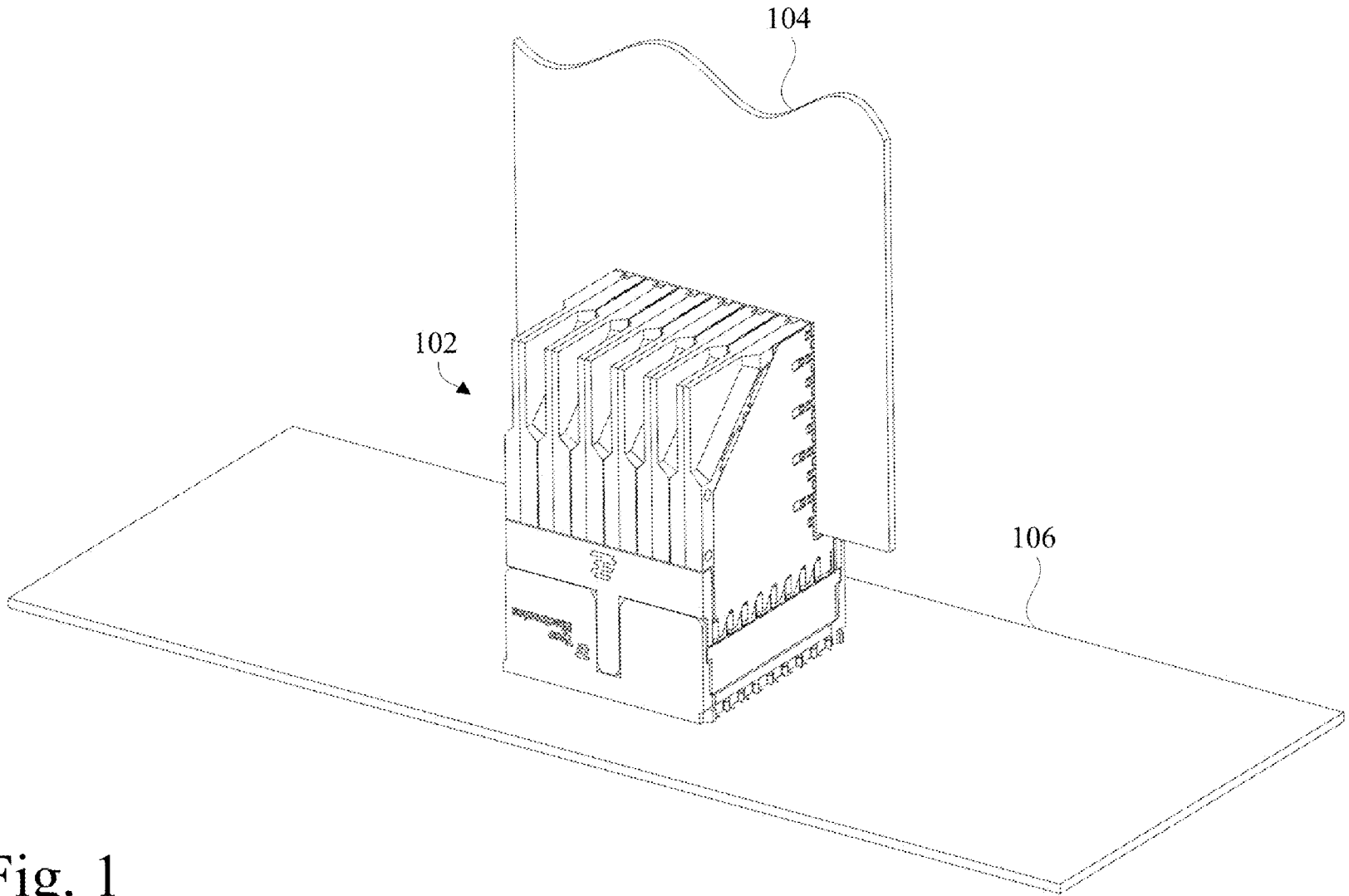
FIG. 1 is a diagram of a backplane connector system connecting a first substrate to a second substrate.

The present disclosure is directed to backplane connector systems that connect with one or more substrates. The backplane connector systems may be capable of operating at high speeds (e.g., up to at least about 25 Gbps), while in some implementations also providing high pin densities (e.g., at least about 50 pairs of electrical connectors per inch). In one implementation, as shown in FIG. 1, a backplane connector system 102 may be used to connect a first substrate 104, such as a printed circuit board, in a parallel or perpendicular relationship with a second substrate 106, such as another printed circuit board. As will be explained in more detail below, implementations of the disclosed connector systems may include ground shielding structures that substantially encapsulate electrical connector pairs, which may be differential electrical connector pairs, in a three-dimensional manner throughout a backplane footprint, a backplane connector, and/or a daughtercard footprint. These encapsulating ground structures, along with a dielectric filler of the differential cavities surrounding the electrical connector pairs themselves, may prevent undesirable propagation of non-traverse, longitudinal, and higher-order modes during operation of the high-speed backplane connector systems.

Figure 2A:
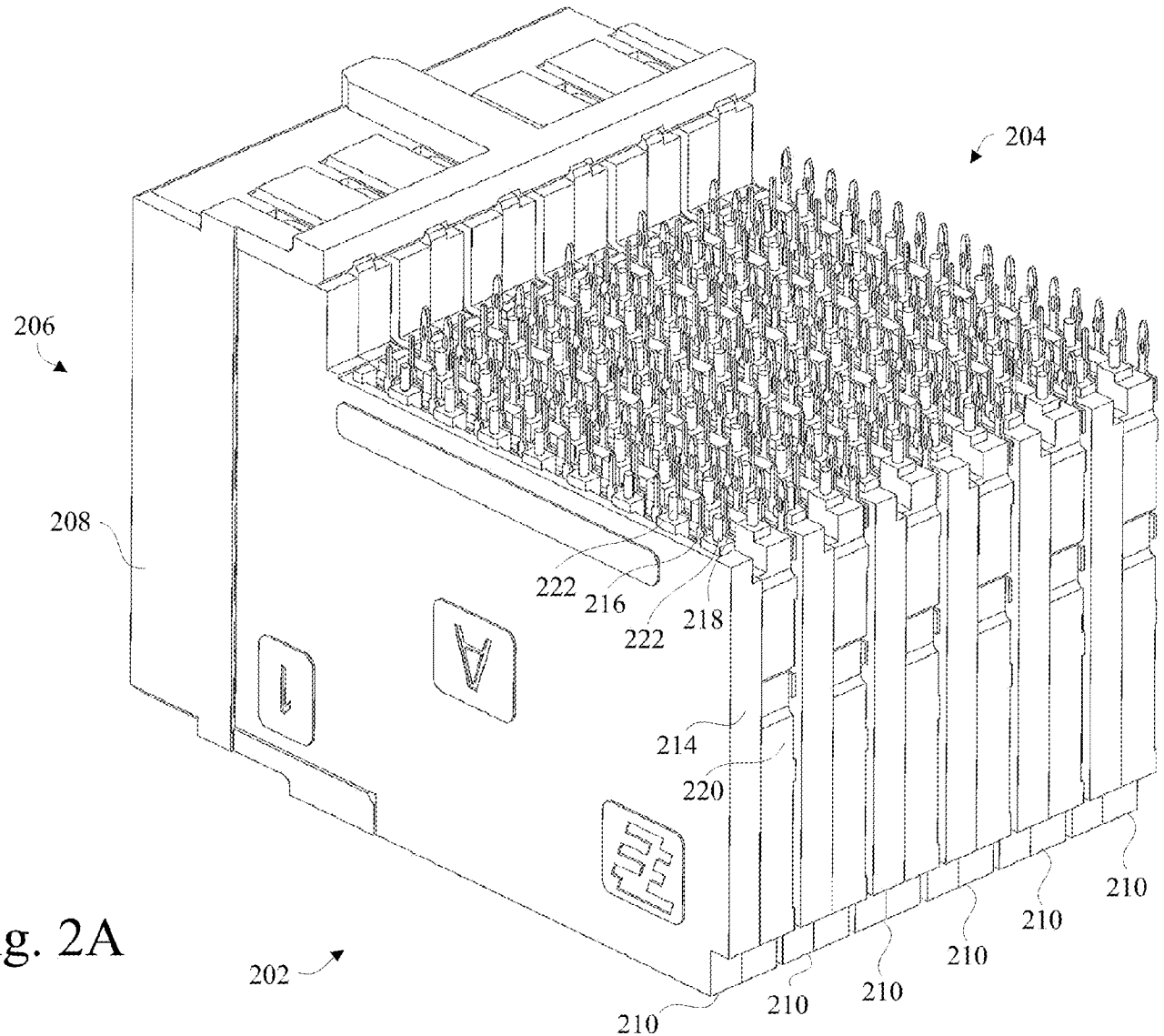
FIG. 2A is a perspective view of an electrical connector system that includes multiple wafer assemblies.

FIG. 2A is a perspective view of an electrical connector system 202 for connecting multiple substrates. In one implementation, the electrical connector system 202 has a mounting end 204 that connects with a first substrate and a mating end 206 that connects with a second substrate. The connections with the first substrate or the second substrate may be direct or through an interfacing connector. The first and second substrates may be arranged in a substantially perpendicular relationship when engaged with the electrical connector system 202. The electrical connector system 202 may include a wafer housing 208 and one or more wafer assemblies 210.

The wafer housing 208 serves to receive and position multiple wafer assemblies 210 adjacent to one another within the electrical connector system 202. In one implementation, the wafer housing 208 engages the wafer assemblies 210 at the mating end 206. One or more apertures in the wafer housing 208 are dimensioned to allow mating connectors extending from the wafer assemblies 210 to pass through the wafer housing 208 so that the mating connectors may be connected with corresponding mating connectors associated with a substrate or another mating device, such as the header modules described in U.S. patent application Ser. No. 12/474,568.

The wafer assemblies 210 serve to provide an array of electrical paths between multiple substrates. The electrical paths may be signal paths, power transmission paths, or ground potential paths. In the implementation shown in FIGS. 2A and 2B, each wafer assembly 210 includes a first housing 214, a first array of electrical contacts 216 (also known as a first lead frame assembly), a second array of electrical contacts 218 (also known as a second lead frame assembly), a second housing 220, projections 222, and a ground shield 228. FIG. 2B shows a partially exploded view of the electrical connector system 202 of FIG. 2A. In other implementations, the wafer assemblies 210 may each include one center housing (e.g., with channels for the two contact arrays formed on each side of the center housing), multiple outer housings, one center housing with multiple outer housings, or other housing configurations.

In the implementation of FIGS. 2A and 2B, the first housing 214 of a wafer assembly 210 includes a conductive surface that defines a plurality of channels 223 dimensioned to receive the first array of electrical contacts 216. In this implementation, the second housing 220 also includes a conductive surface that defines a plurality of channels dimensioned to receive the second array of electrical contacts 218. The channels of the second housing 220 may be substantially similar to the channels 223 illustrated in FIG. 2B. In some implementations, the channels may be lined with an insulation layer, such as an overmolded plastic dielectric, so that when the first and second arrays of electrical contacts 216 and 218 are positioned substantially within their respective channels, the insulation layer electrically isolates the electrical contacts from the conductive surface of the first and second housings 214 and 220. In other implementations, the insulation layer may be applied directly to the arrays of electrical contacts 216 and 218. After the arrays of electrical contacts 216 and 218 have been positioned within the housing components 214 and 220, the housings 214 and 220 are joined together to form the wafer assembly 210.

The arrays of electrical contacts 216 and 218 of the wafer assembly 210 may include a series of substrate engagement elements, such as electrical contact mounting pins 224 shown in FIG. 2B. In one implementation, the substrate engagement elements are signal contacts that mechanically and electrically couple the wafer assemblies 210 with a substrate. When the first and second arrays of electrical contacts 216 and 218 are positioned within the plurality of channels in the housing components 214 and 220, the substrate engagement elements extend away from the mounting end 204 of the wafer assembly 210 to couple with a first substrate. Similarly, mating connectors 226 of the first and second arrays of electrical contacts 216 and 218 extend away from the mating end 206 of the wafer assembly 210 to couple with a second substrate or another mating device, such as a header module. The mating connectors may be closed-band shaped, tri-beam shaped, dual-beam shaped, circular shaped, male, female, hermaphroditic, or another mating connector style.

When the first array of electrical contacts 216 is positioned substantially within the plurality of channels 223 of the first housing 214 and the second array of electrical contacts 218 is positioned substantially within the plurality of channels of the second housing 220, each electrical contact of the first array of electrical contacts 216 may be positioned adjacent to an electrical contact of the second array of electrical contacts 218. In some implementations, the first and second arrays of electrical contacts 216 and 218 are positioned in the plurality of channels such that a distance between adjacent electrical contacts is substantially the same throughout the wafer assembly 210. Together, the adjacent electrical contacts of the first and second arrays of electrical contacts 216 and 218 form a series of electrical contact pairs. In some implementations, the electrical contact pairs may be differential pairs of electrical contacts. For example, the electrical contact pairs may be used for differential signaling.

In some implementations, for each electrical contact pair, the electrical contact of the first array of electrical contacts 216 mirrors the adjacent electrical contact of the second array of electrical contacts 218. Mirroring the electrical contacts of the electrical contact pair may provide advantages in manufacturing as well as column-to-column consistency for high-speed electrical performance, while still providing a unique structure in pairs of two columns.

The first and second housings 214 and 220 of the wafer assembly 210 may be formed to have a conductive surface. For example, the first and second housings 214 and 220 may be formed as plated plastic ground shell housings. In some implementations, each of the first and second housings 214 and 220 comprises a plated plastic or diecast ground wafer, such as tin (Sn) over nickel (Ni) plated or a zinc (Zn) die cast. In other implementations, the first and second housings 214 and 220 may comprise an aluminum (Al) die cast, a conductive polymer, a metal injection molding, or any other type of metal.

The first and second arrays of electrical contacts 216 and 218 of the wafer assembly 210 may be formed from a conductive material. In some implementations, the first and second arrays of electrical contacts 216 and 218 comprise phosphor bronze and gold (Au) or tin (Sn) over nickel (Ni) plating. In other implementations, the first and second arrays of electrical contacts 216 and 218 may comprise any copper (Cu) alloy material. The platings could be any noble metal such as palladium (Pd) or an alloy such as palladium-nickel (Pd—Ni) or gold (Au) flashed palladium (Pd) in the contact area, tin (Sn) or nickel (Ni) in the mounting area, and nickel (Ni) in the underplating or base plating.

As shown in FIG. 2B, the electrical connector system 202 may also include a ground shield 228. The ground shield 228 may be coupled to a side face of the housing 220 or may be integrated into the housing 220. The ground shield 228 includes substrate engagement elements, such as ground mounting pins 230, at the mounting end of the wafer assembly to engage with a substrate when the wafer assembly is mounted to the substrate.

Figure 3:
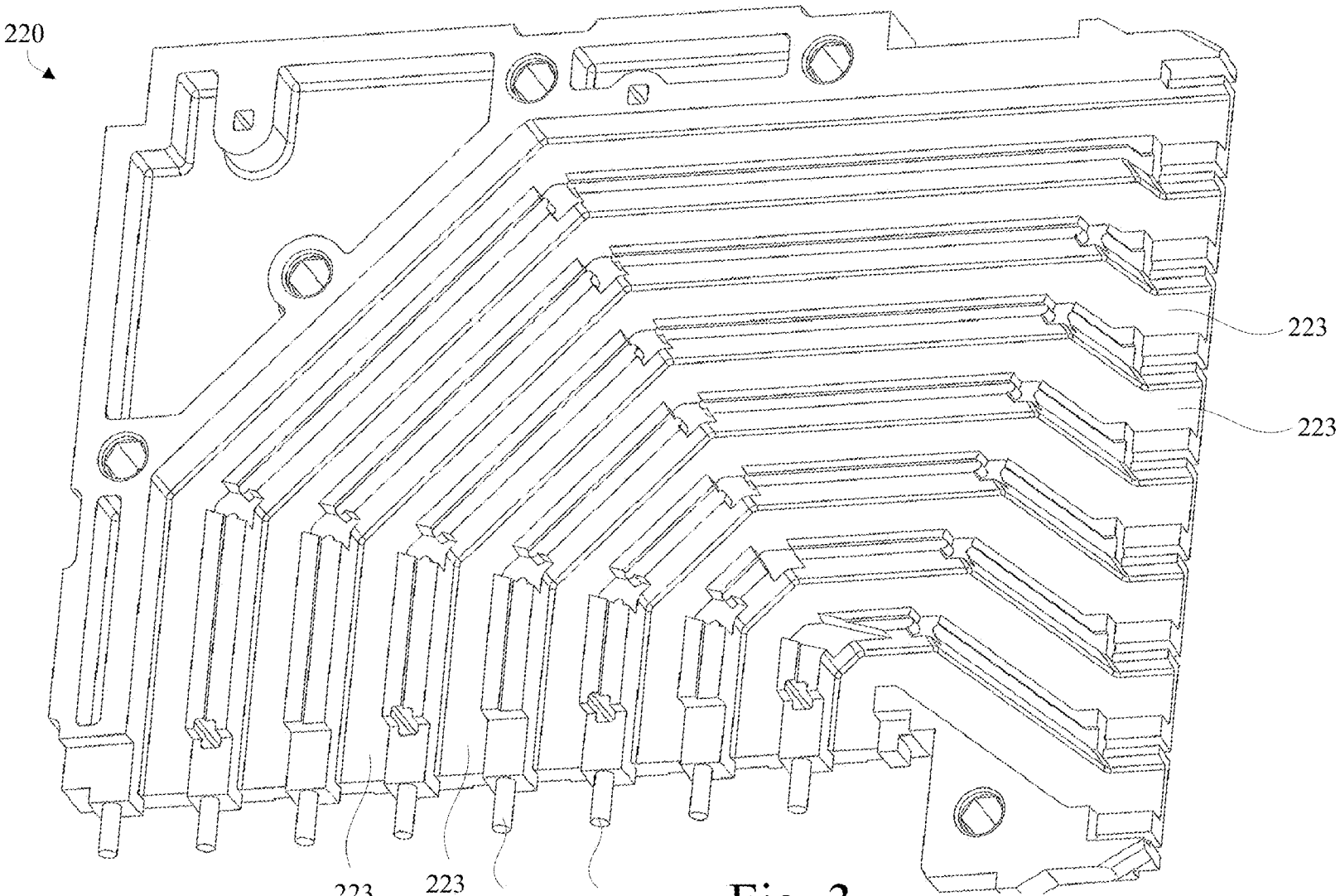
FIG. 3 is a perspective view of a housing component of a wafer assembly.
Figure 4:
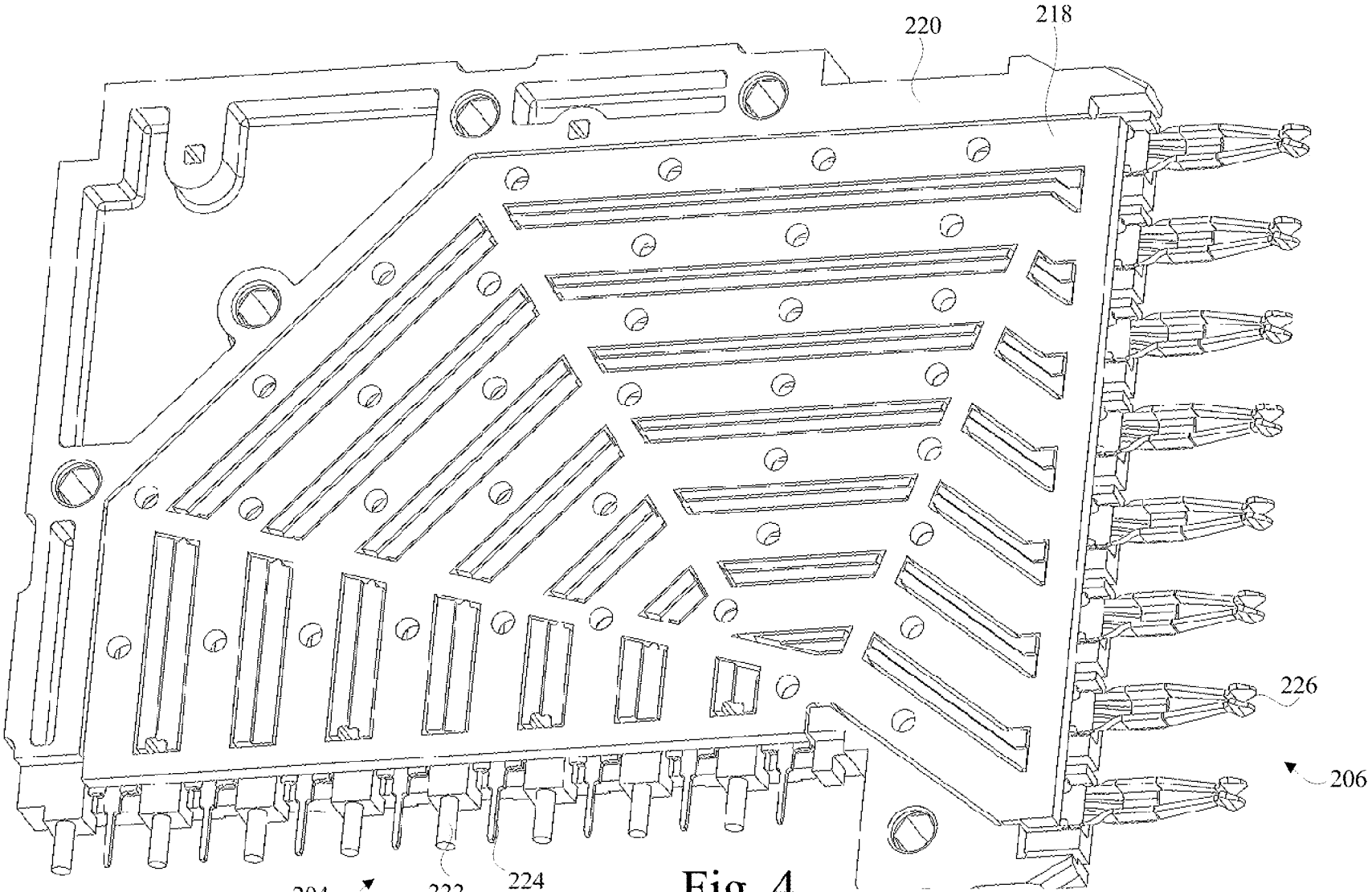
FIG. 4 shows an array of electrical contacts fit into the housing component of FIG. 3.
Figure 5:
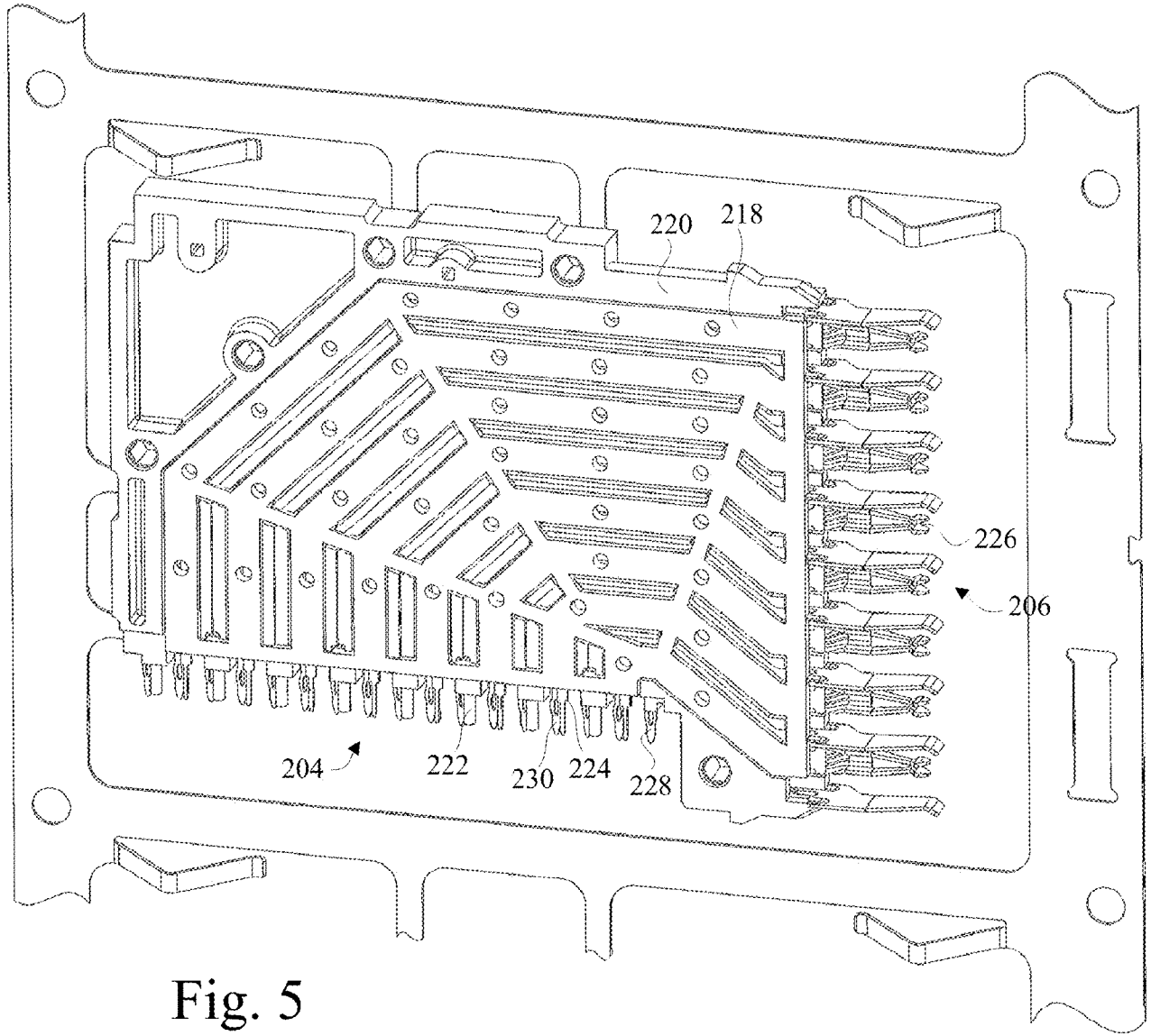
FIG. 5 shows another view of an array of electrical contacts fit into the housing component of FIG. 3.

FIG. 3 shows one of the housing components of a wafer assembly 210, such as the housing component 220. FIG. 4 shows an array of electrical contacts, such as the array of electrical contacts 218, fit into the housing component 220. FIG. 5 shows the ground shield 228 added to the housing 220. The portion of the ground shield 228 that is visible around the outside of the housing component 220 is a manufacturing frame that may be removed before operation.

Figure 6:
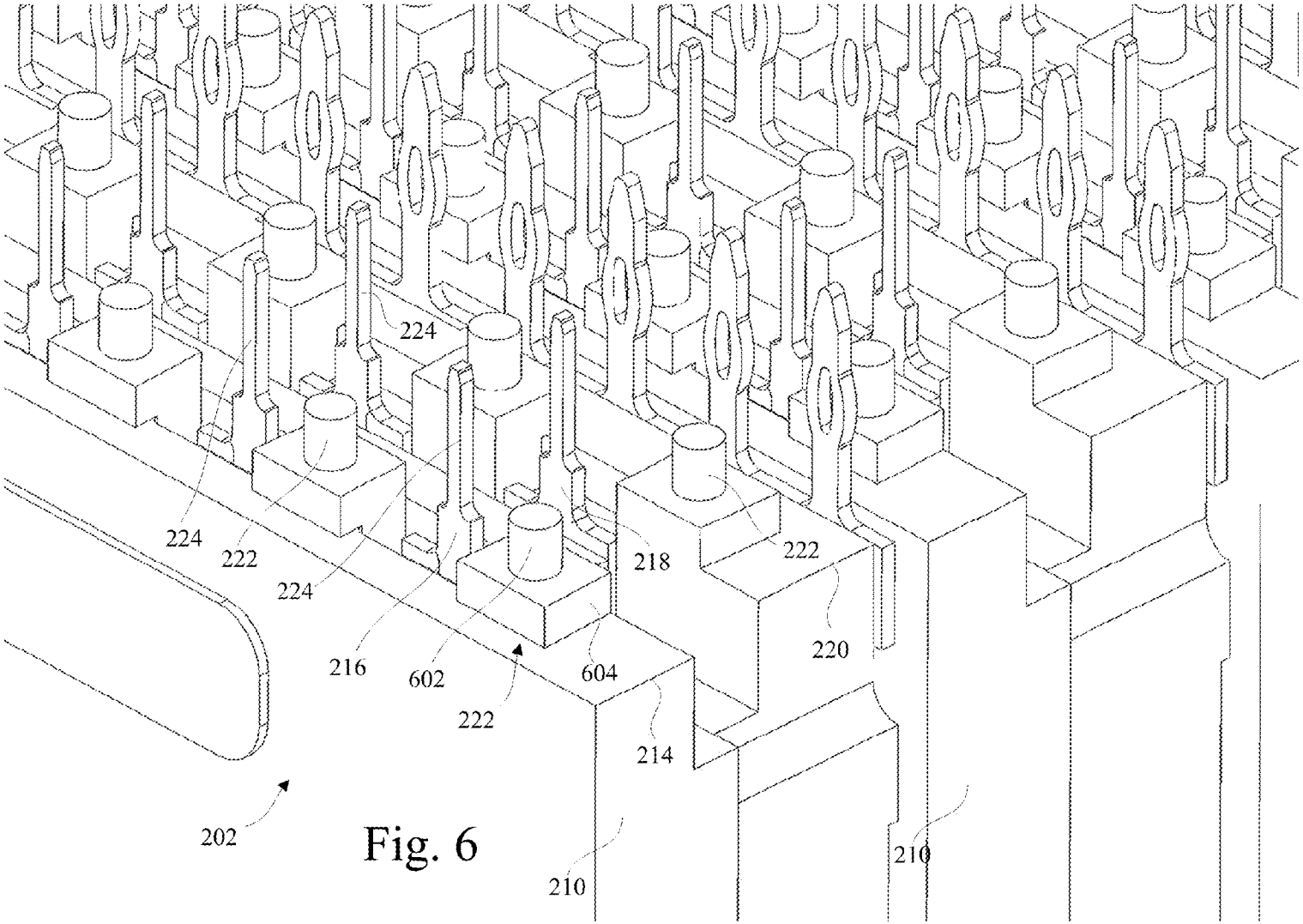
FIG. 6 is an enlarged view of a portion of the electrical connector system of FIG. 2A.

Referring to FIG. 6, the wafer assemblies 210 include a plurality of projections 222. For example, the housing 214 may define a first group of projections 222 extending from an edge of the housing 214 at a mounting end of the wafer assembly 210. Similarly, the housing 220 may define a second group of projections 222 extending from an edge of the housing 220 at a mounting end of the wafer assembly 210. At least a portion of each projection 222 may be dimensioned to fit into corresponding holes in a substrate when the housing components 214 and 220 of a wafer assembly 210 are engaged with the substrate.

Figure 9:
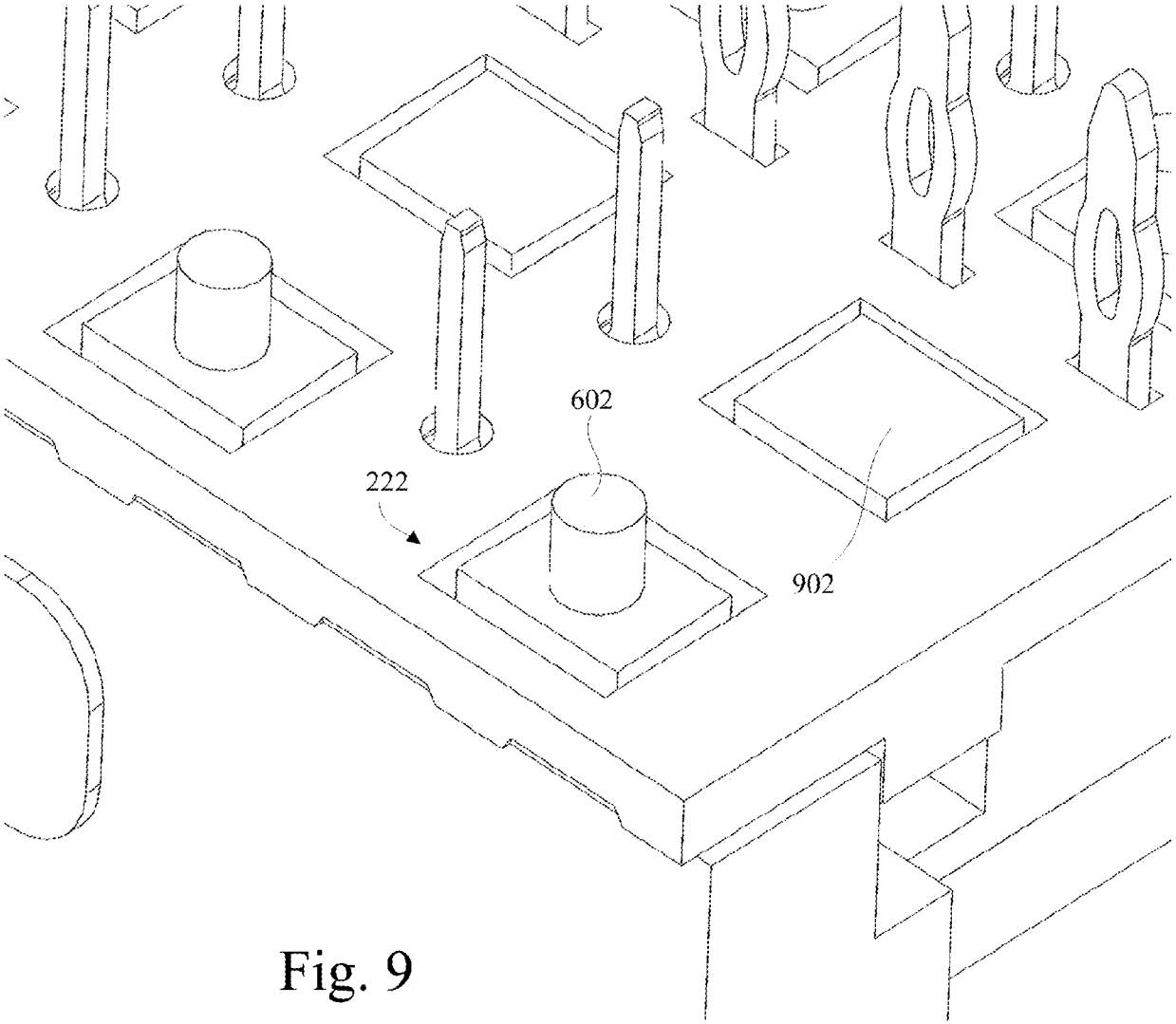
FIG. 9 shows a perspective view of another electrical connector system.

In one implementation, as shown in FIG. 6, each of the projections 222 may include a cylindrical substrate engagement portion 602 dimensioned to fit into one of the corresponding holes in the substrate, and a rectangular shoulder portion 604 at a base of the cylindrical portion 602. The shoulder portion 604 may be wider than the cylindrical portion 602, as shown in FIG. 6. In other implementations, different configurations may be used for the projections 222. For example, the shapes of the substrate engagement portion 602 and/or the shoulder portion 604 may be different than shown in FIG. 6. Additionally, in some implementations, a subset of the projections in the electrical connector system 202 may be different than other projections in the electrical connector system 202, as shown in FIG. 9.

The projections 222 shown in FIG. 6 may serve as ground posts configured to connect with a ground potential contact of the substrate to provide a common ground potential between the substrate and the housing component associated with the projection 222. For example, a projection 222 that extends from the housing component 214 may engage with a ground potential contact in the substrate to provide a common ground potential between the substrate and the housing component 214.

In one implementation, the projections 222 may be formed as integral portions of the housings 214 and 220. For example, a mold used to form the housings 214 and 220 may include portions dimensioned to form the projections 222. Therefore, the projections 222 may have a similar construction, and be made from similar materials, as the housings 214 and 220. As one example, the projections 222 may be molded plastic projections with conductive platings. As another example, the projections 222 may be formed from solid metal or another conductive material. In some implementations, the projections 222 are formed separately from the housings 214 and 220 of the wafer assembly 210, and then attached to the housings 214 and 220.

Referring to FIG. 6, the projections 222 may serve to at least partially block a line-of-sight between adjacent signal contacts of the arrays of signal contacts 216 and 218. For example, a portion of the projections 222 may at least partially block a direct line path between adjacent signal contacts. By at least partially blocking the direct line path between two signal contacts, the projections 222 may help reduce interference propagation between the two signal contacts. For example, the projections 222 may reduce crosstalk between adjacent signal contacts. Crosstalk may occur when a signal traveling along a first signal pin interferes with a signal traveling along a second signal pin.

In one implementation, the plurality of projections 222 of the first housing 214 are positioned on the first housing 214 to block a line-of-sight between each adjacent pair of signal substrate engagement elements, such as the electrical contact mounting pins 224, in the first array of electrical contacts 216. Similarly, the plurality of projections 222 of the second housing 220 may be positioned on the second housing 220 to block a line-of-sight between each adjacent pair of signal substrate engagement elements, such as the electrical contact mounting pins 224, in the second array of electrical contacts 218.

Figure 7:
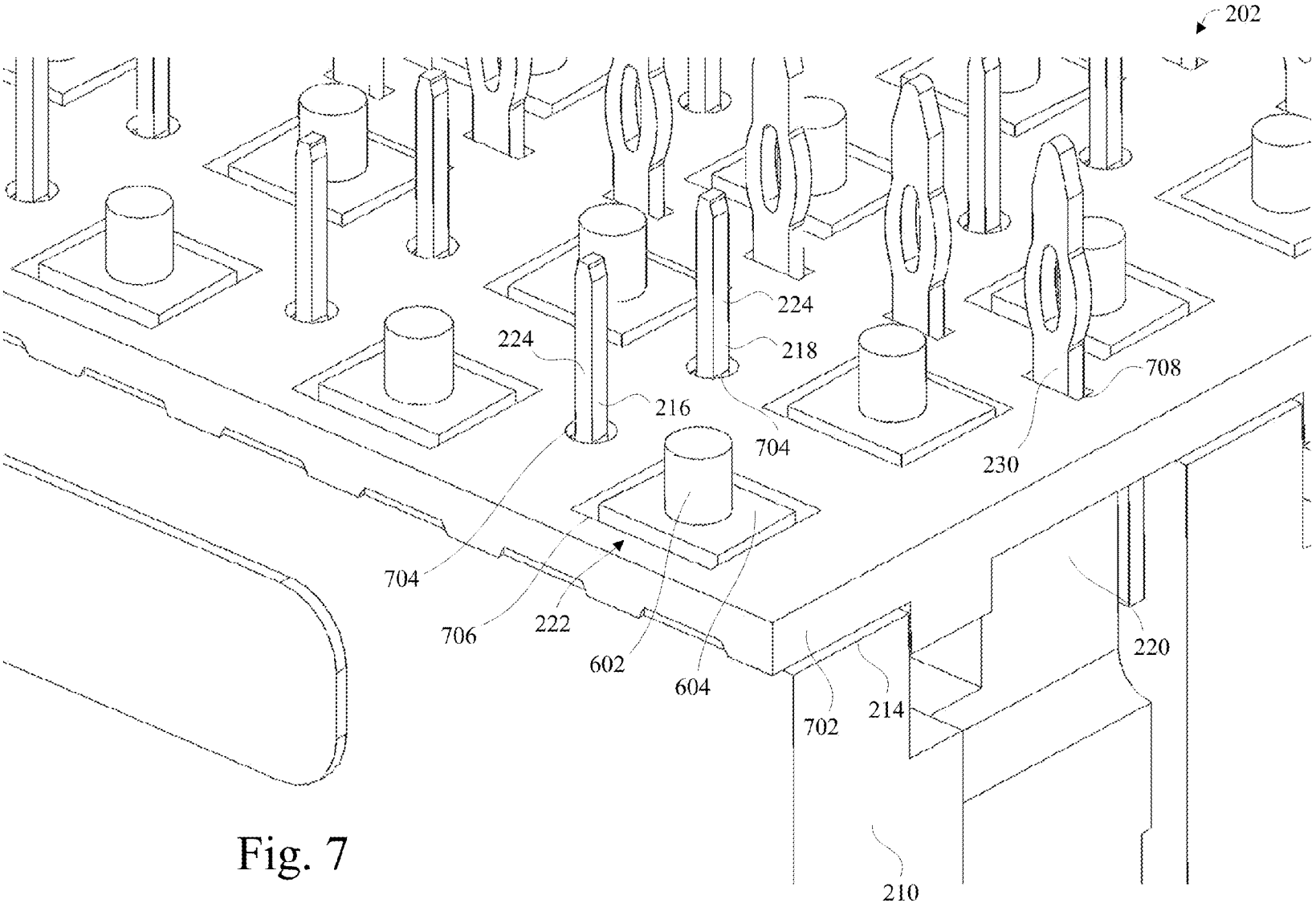
FIG. 7 shows an electrical connector system that includes an organizer.

FIG. 7 shows an electrical connector system 202 that includes an organizer 702 positioned at the mounting end of a plurality of wafer assemblies 210. The organizer 702 includes apertures 704 dimensioned to allow substrate engagement elements, such as the electrical contact mounting pins 224 of the arrays of electrical contacts 216 and 218, to pass through the organizer 702 and connect with a substrate. The organizer 702 may also include apertures 706 dimensioned to allow the projections 222 that extend from the housings of the wafer assemblies 210 to pass through the organizer 702 and connect with the substrate. Additionally, the organizer 702 may include apertures 708 dimensioned to allow the ground mounting pins 230 of the ground shield 228 to pass through the organizer 702 and connect with the substrate.

When the wafer assemblies 210 are mounted to a substrate, such as a printed circuit board, the projections 222 extend through the organizer 702 and contact the substrate. By extending projections 222 from the housings of the wafer assemblies 210 to the substrate, the projections 222 may provide shielding to the electrical contact mounting pins of the arrays of electrical contacts 216 and 218 as they pass through the organizer 702.

In some implementations, the shoulder portion 604 of the projections 222 extending from the first and/or second housings 214 and 220 are flush with the organizer 702, as shown in FIG. 7, so that when the wafer assemblies 210 are mounted to the substrate, both the shoulder portion 604 of the projections 222 and the organizer 702 contact the substrate. In other implementations, the shoulder portion 604 of the projections 222 extends past the mounting surface of the organizer 702. When the projections 222 extend past the mounting surface of the organizer 702, an air gap may be created between the organizer 702 and a substrate when the wafer assemblies 210 are mounted to the substrate. The air gap may assist in electrically isolating at least a portion of the electrical contact mounting pins 224 of the arrays of electrical contacts 216 and 218. In some implementations, a distance between the organizer 702 and the substrate (the air gap) may be greater than zero but less than or equal to substantially 0.5 mm.

Figure 8A:
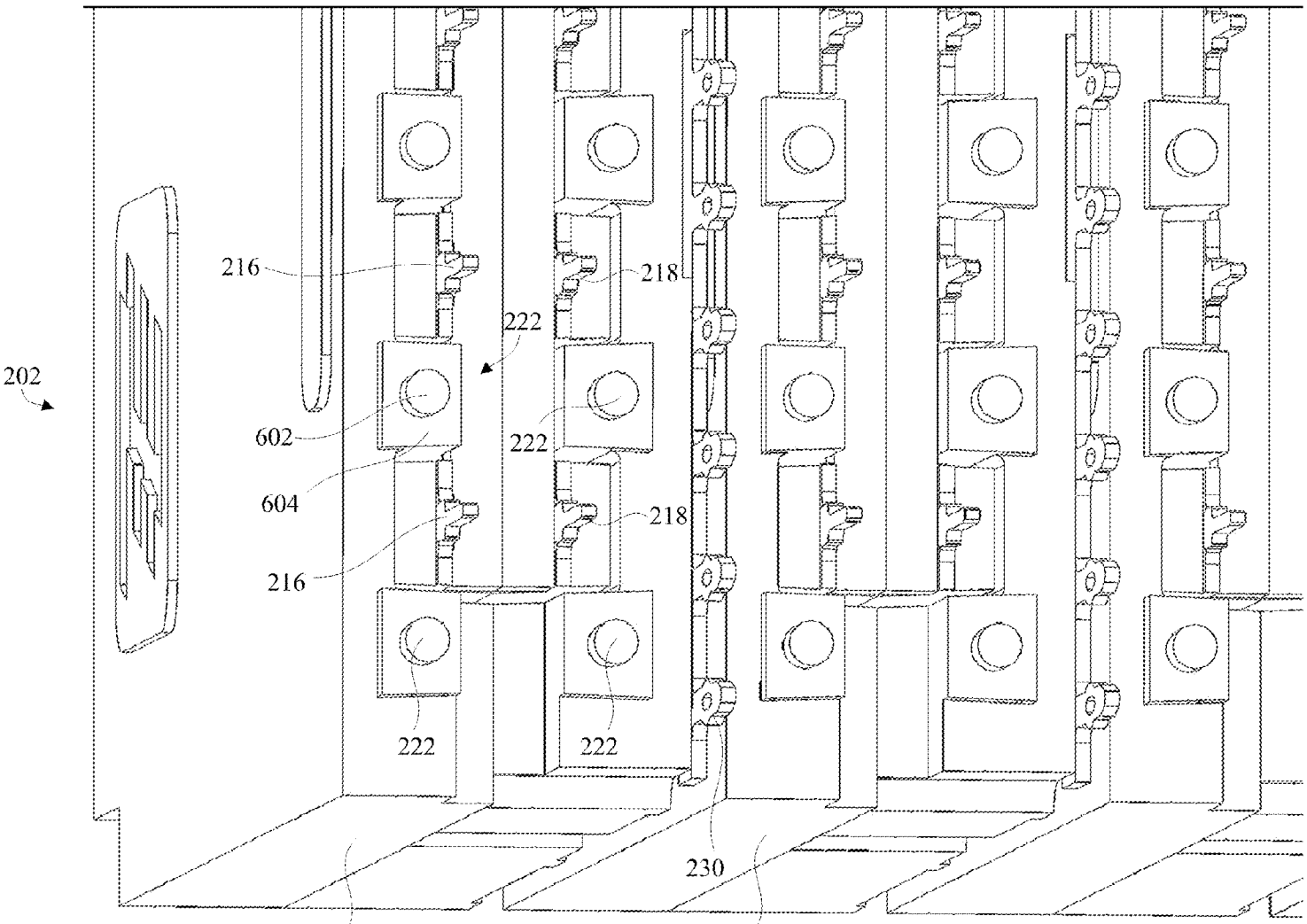
FIG. 8A is a perspective view of the mounting end of an electrical connector system.
Figure 8B:
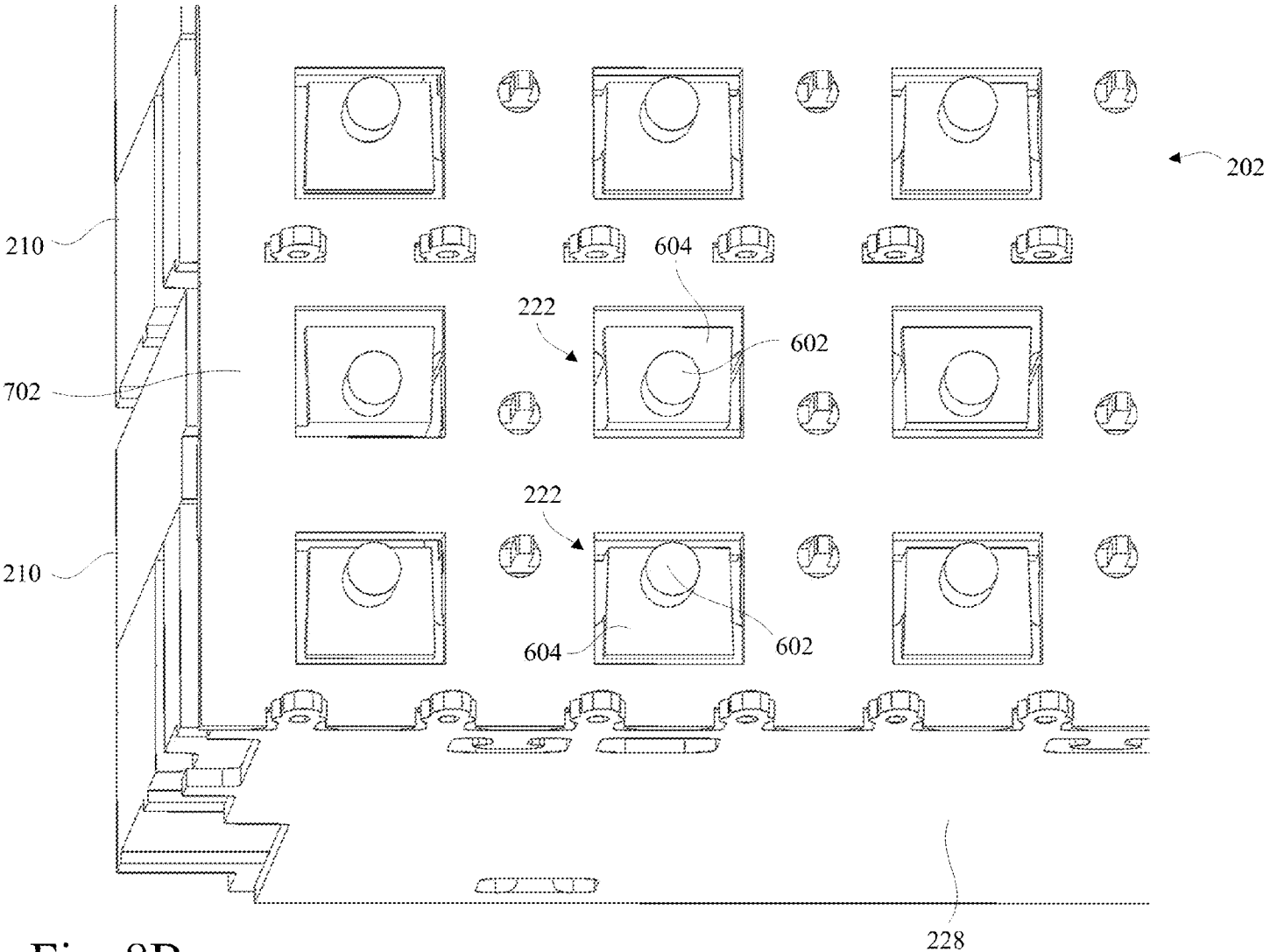
FIG. 8B is another perspective view of the mounting end of an electrical connector system.

FIGS. 8A and 8B are perspective views of the mounting end of an electrical connector system. FIGS. 8A and 8B show the projections 222 at least partially blocking a line-of-sight between adjacent electrical contact mounting pins 224 in the arrays of electrical contacts 216 and 218. In FIG. 8A, the substrate engagement portion 602 is shown substantially centered in the middle of the shoulder portion 604. In FIG. 8B, the substrate engagement portion 602 is shown offset from the center of the shoulder portion 604 so that the substrate engagement portion 602 may block a larger portion of a line-of-sight between adjacent signal contacts of the arrays of electrical contacts 216 and 218.

Referring to FIG. 9, in some implementations, a subset of the projections in an electrical connector system may be different than other projections in the electrical connector system. For example, some projections 222 may include a substrate engagement portion 602 while other projections 902 may not include such features.

Figure 10:
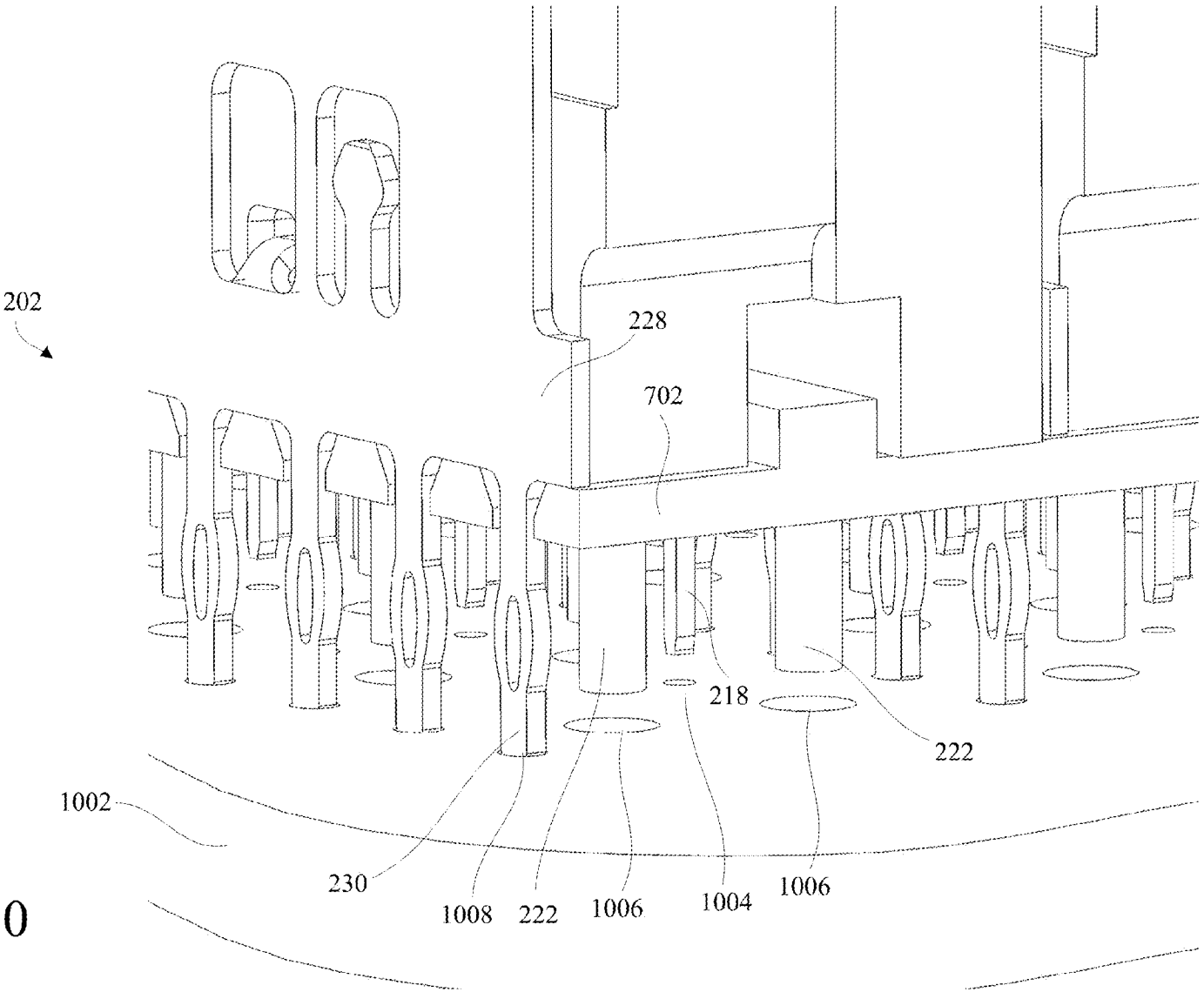
FIG. 10 is a perspective view of an electrical connector system about to engage with a substrate.

FIG. 10 shows the electrical connector system 202 about to connect with a substrate 1002. In some implementations, the substrate 1002 comprises a printed circuit board with multiple signal vias (e.g., via 1004) and multiple ground vias (e.g., vias 1006 and 1008). The signal vias may mechanically and electrically connect with the signal contacts of the wafer assemblies 210 to couple the wafer assemblies 210 with the substrate 1002. Electrical signals may then pass between the substrate 1002 and the wafer assemblies 210 through the signal contacts. The ground vias may mechanically and electrically connect with ground contacts of the electrical connector system 202. For example, the projections 222 of the wafer assemblies 210 may couple with the ground vias 1006. A common ground potential may then be shared between the substrate 1002 and the housings of the wafer assemblies 210. Additionally, the ground mounting pins 230 of the ground shield 228 may couple with the ground vias 1008. A common ground potential may then be shared between the substrate 1002 and the ground shield 228.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An electrical connector system, comprising:

a plurality of wafer assemblies, each wafer assembly comprising:

a first housing defining a plurality of projections extending from an edge of the first housing at a mounting end of the wafer assembly; and a second housing configured to mate with the first housing, the second housing defining a plurality of projections extending from an edge of the second housing at the mounting end of the wafer assembly;

wherein at least a portion of a projection of the plurality of projections of the first housing and at least a portion of a projection of the plurality of projections of the second housing are dimensioned to fit into corresponding holes in a substrate when the first housing and the second housing are engaged with the substrate;

wherein the plurality of projections extending from the edge of the first housing are part of the first housing, and wherein the first housing is configured to engage with a first array of electrical contacts that define substrate engagement elements.

2. The electrical connector system of claim 1, wherein the plurality of projections of the first housing comprise a plurality of ground posts configured to connect with the substrate to provide a common ground potential between the substrate and the first housing.

3. The electrical connector system of claim 1, wherein the first housing defines a plurality of first electrical contact channels dimensioned to receive the first array of electrical contacts, and wherein the substrate engagement elements of the first array of electrical contacts extend past the edge of the first housing at the mounting end of the wafer assembly.

4. The electrical connector system of claim 3, wherein the substrate comprises a printed circuit board with a first signal via, a second signal via, and a ground via between the first signal via and the second signal via;

wherein the first array of electrical contacts comprises a first signal substrate engagement element configured to connect with the first signal via;

wherein the first array of electrical contacts comprises a second signal substrate engagement element configured to connect with the second signal via; and wherein the plurality of projections of the first housing comprise a ground post configured to connect with the ground via, and block a line-of-sight between the first signal substrate engagement element and the second signal substrate engagement element.

5. The electrical connector system of claim 3, wherein the plurality of projections of the first housing comprise a first projection positioned to block a line-of-sight between a first signal substrate engagement element of the first array of electrical contacts and a second signal substrate engagement element of the first array of electrical contacts.

6. The electrical connector system of claim 5, wherein the plurality of projections of the first housing comprise a second projection positioned to block a line-of-sight between the second signal substrate engagement element of the first array of electrical contacts and a third signal substrate engagement element of the first array of electrical contacts.

7. The electrical connector system of claim 3, wherein the second housing defines a plurality of second electrical contact channels, and wherein each wafer assembly further comprising a second array of electrical contacts positioned substantially within the plurality of second electrical contact channels, each electrical contact of the second array of electrical contacts defining a signal substrate engagement element extending past the edge of the second housing at the mounting end of the wafer assembly.

8. The electrical connector system of claim 7, wherein the plurality of projections of the first housing are positioned on the first housing to block a line-of-sight between each adjacent pair of signal substrate engagement elements in the first array of electrical contacts; and wherein the plurality of projections of the second housing are positioned on the second housing to block a line-of-sight between each adjacent pair of signal substrate engagement elements in the second array of electrical contacts.

9. The electrical connector system of claim 1, wherein the plurality of projections of the first housing each comprise:

a cylindrical portion dimensioned to fit into one of the corresponding holes in the substrate; and a shoulder portion at a base of the cylindrical portion, wherein the shoulder portion is wider than the cylindrical portion.

10. The electrical connector system of claim 1, wherein the plurality of projections extending from the edge of the first housing are formed as integral portions of the first housing.

11. An electrical connector system, comprising:

a plurality of wafer assemblies, each wafer assembly comprising:

a first housing defining a plurality of projections extending from an edge of the first housing at a mounting end of the wafer assembly; and a second housing configured to mate with the first housing, the second housing defining a plurality of projections extending from an edge of the second housing at the mounting end of the wafer assembly;

wherein at least a portion of a projection of the plurality of projections of the first housing and at least a portion of a projection of the plurality of projections of the second housing are dimensioned to fit into corresponding holes in a substrate when the first housing and the second housing are engaged with the substrate; and wherein the plurality of projections of the first housing comprise molded plastic projections with conductive platings.

12. A wafer assembly, comprising:

a housing defining a plurality of electrical contact channels and a plurality of projections extending from an edge of the housing at a mounting end of the wafer assembly; and an array of electrical contacts positioned substantially within the plurality of electrical contact channels, wherein the array of electrical contacts defines a plurality of signal substrate engagement elements extending past the edge of the housing at the mounting end of the wafer assembly;

wherein at least a portion of a first projection of the plurality of projections is dimensioned to fit into a corresponding hole in a substrate when the housing is engaged with the substrate, and wherein the first projection is positioned on the housing to block a line-of-sight between a first signal substrate engagement element of the array of electrical contacts and a second signal substrate engagement element of the array of electrical contacts.

13. The wafer assembly of claim 12, wherein the plurality of projections comprise a plurality of molded plastic ground posts with conductive platings configured to connect with the substrate to provide a common ground potential between the substrate and the housing.

14. The wafer assembly of claim 12, wherein the substrate comprises a printed circuit board with a first signal via, a second signal via, and a ground via between the first signal via and the second signal via;

wherein the first signal substrate engagement element is configured to connect with the first signal via, wherein the second signal substrate engagement element is configured to connect with the second signal via; and wherein the first projection is configured to connect with the ground via, and block a line-of-sight between the first signal substrate engagement element and the second signal substrate engagement element.

15. The wafer assembly of claim 12, wherein the plurality of projections comprise a second projection positioned to block a line-of-sight between the second signal substrate engagement element of the array of electrical contacts and a third signal substrate engagement element of the array of electrical contacts.

16. The wafer assembly of claim 12, wherein the plurality of projections are positioned on the housing to block a line-of-sight between each adjacent pair of signal substrate engagement elements in the array of electrical contacts.

17. The wafer assembly of claim 12, wherein the first projection comprises:

a cylindrical portion dimensioned to fit into one the corresponding hole in the substrate; and a shoulder portion at a base of the cylindrical portion, wherein the shoulder portion is wider than the cylindrical portion.

18. The wafer assembly of claim 12, wherein the plurality of projections are formed as integral portions of the housing.

19. An electrical connector system, comprising:

a plurality of wafer assemblies, each wafer assembly comprising:

a first housing defining a plurality of first electrical contact channels, the first housing defining a plurality of projections extending from an edge of the first housing at a mounting end of the wafer assembly;

a first array of electrical contacts positioned substantially within the plurality of first electrical contact channels, each electrical contact of the first array of electrical contacts defining a signal substrate engagement element extending past the edge of the first housing at the mounting end of the wafer assembly;

a second housing configured to mate with the first housing, the second housing defining a plurality of second electrical contact channels, the second housing defining a plurality of projections extending from an edge of the second housing at the mounting end of the wafer assembly; and a second array of electrical contacts positioned substantially within the plurality of second electrical contact channels, each electrical contact of the second array of electrical contacts defining a signal substrate engagement element extending past an edge of the second housing at the mounting end of the wafer assembly; and an organizer positioned at the mounting end of the plurality of wafer assemblies, wherein the organizer defines:

a first plurality of apertures dimensioned to allow the signal substrate engagement elements of the first and second arrays of electrical contacts to pass through the organizer and extend away from the organizer; and a second plurality of apertures dimensioned to allow the projections extending from the first and second housings to pass through the organizer; and wherein the plurality of projections of the first housing and the plurality of projections of the second housing are dimensioned to pass through the second plurality of apertures of the organizer and into corresponding holes in a substrate when the first housing and the second housing are engaged with the substrate.

20. The electrical connector system of claim 19, wherein the substrate comprises a printed circuit board with a first signal via, a second signal via, and a ground via between the first signal via and the second signal via;

wherein the first array of electrical contacts comprises a first signal substrate engagement element configured to connect with the first signal via;

wherein the first array of electrical contacts comprises a second signal substrate engagement element configured to connect with the second signal via; and wherein the plurality of projections of the first housing comprise a ground post configured to connect with the ground via, and block a line-of-sight between the first signal substrate engagement element and the second signal substrate engagement element.

21. The electrical connector system of claim 19, wherein the plurality of projections of the first housing are positioned on the first housing to block a line-of-sight between each adjacent pair of signal substrate engagement elements in the first array of electrical contacts; and wherein the plurality of projections of the second housing are positioned on the second housing to block a line-of-sight between each adjacent pair of signal substrate engagement elements in the second array of electrical contacts.

22. The electrical connector system of claim 19, wherein when the mounting end of the plurality of wafer assemblies is mounted to the substrate, the plurality of projections of the first housing and the plurality of projections of the second housings create an air gap between the substrate and the organizer; and wherein the air gap electrically isolates at least a portion of the signal substrate engagement elements of the first and second arrays of electrical contacts.

* * * * *